US005934871A

United States Patent [19]

Murphy

[11] Patent Number: 5,934,871

[45] Date of Patent: Aug. 10, 1999

[54] METHOD AND APPARATUS FOR SUPPLYING A ANTI-OXIDIZING GAS TO AND SIMULTANEOUSLY COOLING A SHAFT AND A FAN IN A HEAT TREATMENT CHAMBER

[76] Inventor: Donald G. Murphy, 14 Chippewa, Lake Barrington, Ill. 60010

[21] Appl. No.: 08/899,539

[22] Filed: Jul. 24, 1997

[51] Int. Cl.[6] ..... F01D 25/08

[52] U.S. Cl. ..... 415/180; 415/1; 415/175

[58] Field of Search ..... 415/180–175, 415/176, 177, 178

[56] References Cited

U.S. PATENT DOCUMENTS

| | | | |
|---|---|---|---|
| 1,953,540 | 4/1934 | Ogden | 415/175 |
| 2,502,204 | 3/1950 | Cole | 415/180 |
| 2,755,989 | 7/1956 | Coward | 415/180 |
| 3,297,239 | 1/1967 | Bullock | 415/175 |
| 3,836,280 | 9/1974 | Koch | 415/175 |
| 4,236,941 | 12/1980 | Main, Jr. . | |
| 4,272,239 | 6/1981 | Thekdi et al. . | |
| 4,743,197 | 5/1988 | Bloom . | |
| 4,769,090 | 9/1988 | Queille . | |
| 4,867,808 | 9/1989 | Heilmann et al. . | |
| 4,909,732 | 3/1990 | Wingens . | |
| 5,052,921 | 10/1991 | Hemsath . | |
| 5,064,173 | 11/1991 | Ecalle et al. . | |
| 5,205,135 | 4/1993 | Lang | 62/381 |
| 5,478,057 | 12/1995 | Wilhelmi et al. . | |
| 5,539,853 | 7/1996 | Jamaluddin et al. . | |
| 5,591,274 | 1/1997 | Takahashi . | |
| 5,611,685 | 3/1997 | Nakajima et al. . | |

*Primary Examiner*—F. Daniel Lopez
*Assistant Examiner*—Richard Woo
*Attorney, Agent, or Firm*—Thomas R. Vigil

[57] ABSTRACT

The method and apparatus for supplying an anti-oxidizing gas to, and simultaneously cooling a shaft and a fan blade used in, a special atmosphere, heat treatment chamber and for minimizing corrosion of the shaft and fan blade comprises the steps of and structure for: providing an elongate enclosure around an end section of a shaft having an outer end mounting a fan blade; surrounding a portion of the enclosure surrounding a portion of the shaft section located inwardly of a point where the fan blade is mounted to the outer end of the shaft section with a water jacket; directing water into the water jacket surrounding the portion of the enclosure surrounding the portion of the shaft section within the shaft enclosure; supplying anti-oxidizing filler gas to the chamber through the enclosure; and directing the gas to and through the enclosure along the shaft section, into and through the fan blade and then into the chamber for establishing a preheated, special atmosphere in the chamber.

13 Claims, 2 Drawing Sheets

METHOD AND APPARATUS FOR SUPPLYING A ANTI-OXIDIZING GAS TO AND SIMULTANEOUSLY COOLING A SHAFT AND A FAN IN A HEAT TREATMENT CHAMBER

BACKGROUND OF THE INVENTION

1. Field of the Invention

The present invention relates to a water and gas cooling system for cooling a shaft and fan blade of a blower assembly in a high temperature heat treatment environment.

2. Description of the Related Art Including Information Disclosed Under 37 CFR §§ 1.97–1.99

In heat treatment apparatus, an anti-oxidizing filler gas or atmosphere containing hydrogen, carbon monoxide and nitrogen is used to suspend methane for carburization, is referred to as an endothermic gas and is supplied to a non-oxidizing heat treatment oven chamber.

Endothermic gas is referred to as Rx gas and is used in heat-treating. The ratio of the components of Rx may vary slightly depending on the fuel gas from which the Rx gas is derived but its function in a heat-treatment process is constant. Rx gas provides a suspension medium for other process gases such as methane and ammonia. Although Rx gas is not really "inert" it is used like an inert gas in many industrial applications.

The anti-oxidizing filler gas or atmosphere is supplied to a heat treatment chamber and circulated therein by a fan or blower. In such devices, a shaft extends through a water cooling jacket to a fan blade inside the heat treating chamber where the shaft is fixed to the fan blade. The other end of the shaft is coupled to a motor shaft. Since high temperatures of up to 2,000° F. are encountered inside the heat treatment chamber, the life of the fan blade and shaft is limited and typically have to be replaced every six months and definitely by one year of use.

Heretofore, the anti-oxidizing filler gas has typically been injected into the heat treatment chamber from a side wall thereof adjacent or near the fan blade of the blower or fan.

Examples of heat treatment apparatus are disclosed in the following U.S. Patents:

| U.S. Pat. No. | Patentee |
|---|---|
| 4,236,941 | Main, Jr. |
| 4,272,239 | Thekdi et al. |
| 4,743,197 | Bloom |
| 4,769,090 | Queille |
| 4,867,808 | Heilmann et al. |
| 4,909,732 | Wingens |
| 5,052,921 | Hemsath |
| 5,064,173 | Ecalle et al. |
| 5,539,853 | Jamaluddin et al. |
| 5,478,057 | Wilhelmi et al. |
| 5,591,274 | Takahashi |
| 5,611,685 | Nakajima et al. |

The Bloom U.S. Pat. No. 4,743,197 discloses a high temperature fan plug for a jet heat recuperator which includes inner and outer face plates spaced apart by tubular spacers extending between the plates to form a heat insulative cavity.

The Wingens U.S. Pat. No. 4,909,732 discloses a heat treatment furnace having a housing surrounding a heating chamber having cooling gas inlets and outlets connected to a cooling gas circulation system for circulating the gas.

The Jamaluddin et al. U.S. Pat. No. 5,539,853 discloses a down hole heating system with separate wiring cooling and heating chambers with gas flow therethrough.

In view of the high temperatures encountered in heat treatment of parts, the fan blade and shaft need to be replaced frequently, typically every six months.

As will be described in greater detail hereinafter, the present invention provides a water and gas cooling system for the shaft and fan blade of a blower assembly for use in a heat treatment chamber that minimizes erosion of the shaft and fan blade or impeller and extends the useful life of the shaft and fan blade by a significant factor, e.g., up to ten. Stated otherwise, the method and apparatus of the present invention can increase the life of the shaft and fan blade from six months to over two years.

By directing the "inert" gas along the shaft into the impeller, erosion is minimized if not altogether eliminated. Typically, on fans where the impeller is relatively close to a protective jacket, i.e., within three inches, gas and debris become trapped in a "dead" area around the shaft just above the impeller. This results in severe erosion problems and premature failure of the alloy(s) from which the shaft and impeller are made. Directing the "inert" process gas along the shaft directly into the impeller eliminates this "dead" area and the consequential erosion problems. Further, due to the dynamic action of the shaft and impeller, the atmosphere inlet becomes self cleaning.

The increase in life of the shaft and fan blade is brought about by directing the anti-oxidizing filler gas radially inwardly to a cylindrical enclosure surrounding the shaft just below a water cooling jacket with a gas inlet pipe and by directing the anti-oxidizing filler gas with the cylindrical enclosure downwardly along the shaft within an insulative housing and to the fan blade.

SUMMARY OF THE INVENTION

According to the present invention there is provided a method for cooling a shaft and a fan blade in a heat treatment chamber and for minimizing corrosion of the shaft and fan blade. The method comprises the steps of:

providing an enclosure around an end of a shaft adjacent a fan blade;

supplying anti-oxidizing filler gas to the enclosure; and directing the gas with the enclosure along the shaft and onto the fan blade.

Further according to the present invention there is provided a shaft mounting structure for a shaft that extends into a heat treatment chamber and has a fan blade mounted on an end thereof in the heat treatment chamber. The shaft mounting structure comprises a shaft cooling and protecting system including: an enclosure around an outer end portion of the shaft extending to the fan blade; structure for supplying anti-oxidizing filler gas to the enclosure; and structure for directing the gas with the enclosure along the shaft and onto the fan blade.

DESCRIPTION OF THE PREFERRED EMBODIMENT(S)

Figure 1:
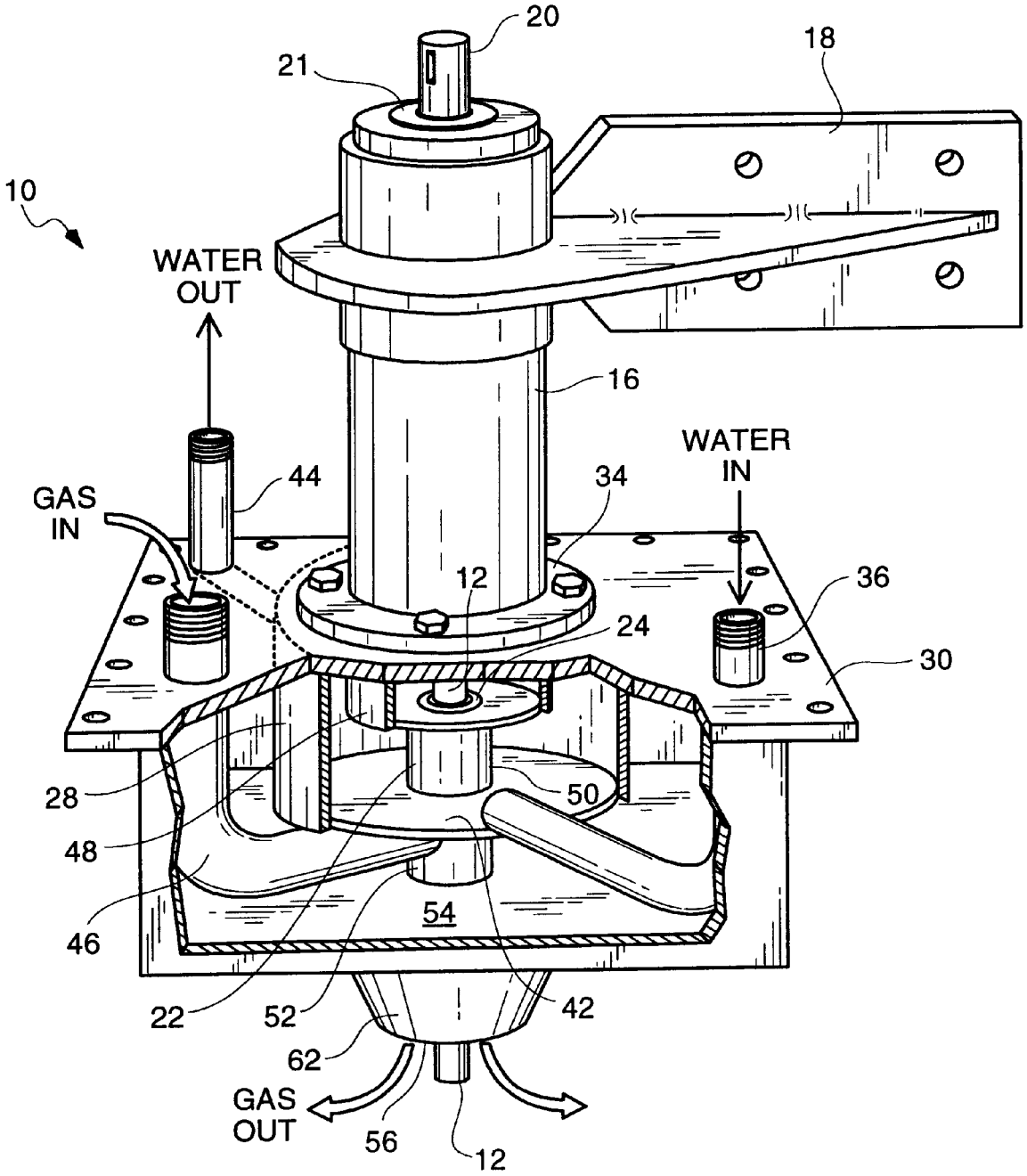
FIG. 1 is a side perspective view of the shaft mounting structure of the present invention with portions cut away to show the flow paths of the water and the gas used to cool the shaft and fan blade of a blower assembly.
Figure 2:
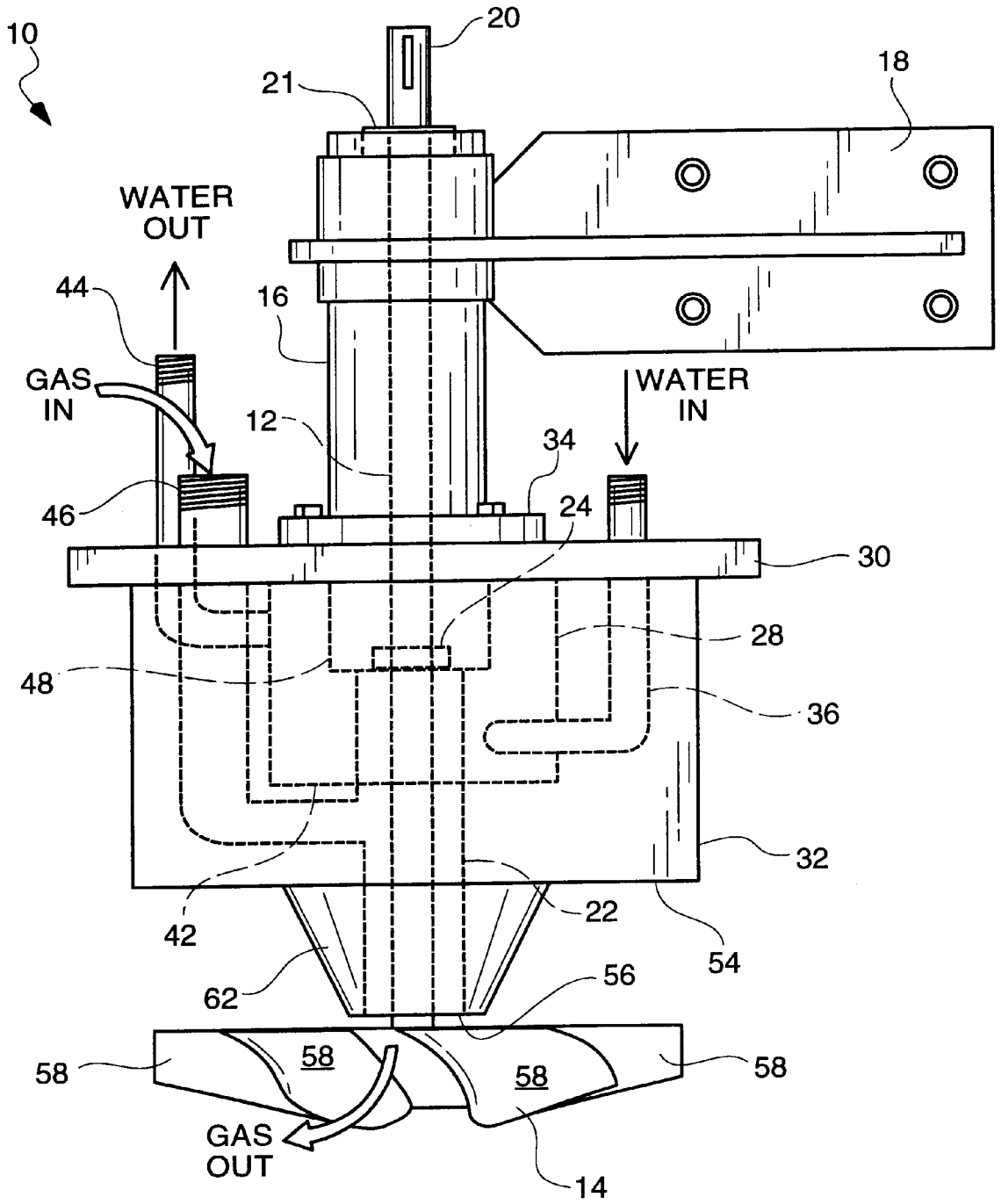
FIG. 2 is a side elevational view of the structure shown in FIG. 1 and shows a fan blade mounted to the lower end of the shaft.

Referring now to FIGS. 1 and 2 of the drawings in greater detail, there is illustrated in FIGS. 1 and 2 a shaft mounting structure 10 for mounting a shaft 12 which extends from a motor coupling (not shown) downwardly to a fan blade 14 (FIG. 2) positioned inside a heat treatment chamber (not shown and located below the structure 10).

The shaft mounting structure 10 includes an upper cylinder 16 having a motor mounting flange 18 affixed thereto and an upper end 20 of the shaft 12 extends outwardly from the top of the cylinder 16 through a bearing 21.

The shaft mounting structure 10 also includes a lower smaller cylinder 22 which encloses the shaft 12 and which is described in greater detail below.

The shaft 12 extends downwardly to a bearing 24 mounted inside the smaller cylinder 22 and inside a generally cylindrical water jacket 28 at the bottom thereof. A top plate 30 of an insulative box shaped housing 32 is located around the cylinder 16 above the bearing 24 and, as shown, a flange 34, surrounds the cylinder 16 and is bolted to the plate 30.

Fixed to the underside of the plate 30 is the insulative box shaped housing 32 which defines a closed insulative airspace below the plate 30.

As shown, a water inlet pipe 36 is provided and extends downwardly through the plate 30 into the housing 32 and then radially inwardly to the water jacket 28 where it discharges water into the water jacket 28. Then, a water outlet pipe 44 extends radially outwardly from the water jacket 28 at a top thereof just below the plate 30 and then upwardly as shown.

According to the teachings of the present invention, an anti-oxidizing filler gas inlet pipe 46 extends downwardly through and is fixed to the plate 30 and then extends radially inwardly to the smaller cylinder 22 surrounding the shaft 12.

Note that a lower end portion 48 of the larger-in-diameter upper cylinder 16 extends into the box shaped housing 32 and simultaneously into the water jacket 28 to assist in heat dissipation.

Note also that the smaller-in-diameter lower cylinder 22 has an upper portion 50 in the water jacket 28 and a lower portion 52 extending from the bottom wall 42 of the water jacket to and through a bottom wall 54 of the box shaped housing 22, also to assist in heat dissipation.

The anti-oxidizing filler gas is delivered through the gas inlet pipe 46 and then radially inwardly to and into the smaller cylinder 22 just below the water jacket 28 where the gas is directed by the smaller cylinder 22 to flow downwardly along the shaft 12 to an outlet opening 56 where the gas engages blades 58 (FIG. 2) of the fan blade 14 where the gas is then dispersed or circulated within the heat treatment chamber by the fan blade 14. The smaller cylinder 22 serves as a gas directing structure within the insulative housing 32.

From the foregoing description, it will be understood that the incoming anti-oxidizing filler gas, which can be nitrogen and hydrogen, is received in the small cylinder 22 and heated by the heat of the shaft 12, thus cooling the shaft 12. This gas is further heated as it flows downwardly to and into the high temperature heat treatment chamber and passes over the fan blade 14.

Since the anti-oxidizing filler gas prevents oxidation of parts, it reduces the corrosion of the shaft 12 and the fan blade 14 as it flows downwardly and then into the heat treatment chamber. Further, the gas flowing downwardly along the shaft 12, being at a lower temperature than the temperature inside the heat treatment chamber, serves to assist in the cooling of the shaft 12 and the fan blade 14 as opposed to the prior art structures where gas is simply injected into the heat treatment chamber for being circulated by the fan blade 14.

Note also that a lower end portion 60 of the smaller cylinder 22 extends below the bottom wall 54 of the housing 32 and is surrounded by a frusto-conically shaped baffle 62 to protect further the shaft 12 from heat and to provide for directing on channeling of the anti-oxidizing filler gas all the way to the fan blade 14 to protect further the shaft 12 from corrosion.

From the foregoing description, it will be apparent that the method and apparatus for cooling a shaft and fan blade for a blower assembly in a heat treatment chamber of the present invention has a number of advantages, some of which have been described above and others of which are inherent in the invention. Also it will be understood that modifications can be made to the method and apparatus for cooling and protecting a fan blade and shaft in a gas delivery system for a heat treatment apparatus chamber without departing from the teachings of the present invention. Accordingly, the scope of the invention is only to be limited as necessitated by the accompanying claims.

I claim:

1. A method for supplying an anti-oxidizing gas to, and simultaneously cooling a shaft and a fan blade used in, a special atmosphere, heat treatment chamber and for minimizing corrosion of the shaft and fan blade comprising the steps of:

providing an elongate enclosure around an end section of a shaft having an outer mounting a fan blade;

surrounding at least a portion of the enclosure with a circulating fluid cooling jacket;

supplying anti-oxidizing filler gas to the chamber through the enclosure; and directing the gas to and through the enclosure along the shaft section, into and through the fan blade and then into the chamber for establishing a preheated, special atmosphere in the chamber.

2. The method of claim 1 including the steps of:

surrounding a portion of the enclosure surrounding a portion of the shaft section located inwardly of a point where the fan blade is mounted to the outer end of the shaft section with a water jacket defining the cooling jacket; and, directing water into the water jacket surrounding said portion of the enclosure surrounding said portion of the shaft section within the shaft enclosure.

3. The method of claim 2 including the step of removing water from the water jacket through a water outlet pipe.

4. The method of claim 1 including the step of supplying the anti-oxidizing filler gas to the enclosure in a radial path to the enclosure which encircles the shaft and then to and through the fan and into the heat treatment chamber.

5. A shaft mounting structure for a shaft section that extends into a special atmosphere, heat treatment chamber and has a fan blade mounted on an outer end thereof in the heat treatment chamber, comprising a shaft cooling and protecting system including: an insulating jacket comprising a housing; an enclosure in said housing around said shaft section extending to said fan blade; a circulating fluid cooling jacket surrounding at least a portion of said enclosure; means for supplying anti-oxidizing filler gas through said enclosure to said heat treatment chamber; and means for directing the gas radially to said enclosure and radially to and axially along said shaft section to and through said fan blade and into said heat treatment chamber.

6. The shaft mounting structure of claim 5 wherein said cooling jacket is a water jacket surrounding a portion of said shaft enclosure located inwardly of a point where said fan blade is mounted to said outer end of said shaft section and means for directing water into said water jacket surrounding said portion of said shaft enclosure.

7. The shaft mounting structure of claim 5 including means for removing water from said water jacket including a water outlet pipe that extends outwardly and upwardly from said water jacket.

8. The shaft mounting structure of claim 5 including a gas inlet pipe that extends in a radial path through said housing to said shaft enclosure which encircles said shaft.

9. The shaft mounting structure of claim 5 wherein said housing surrounds said water jacket and said shaft enclosure.

10. The shaft mounting structure of claim 9 wherein a lower end portion of said shaft enclosure extends below said housing to said fan blade.

11. The shaft mounting structure of claim 10 wherein said lower end portion of said shaft enclosure is surrounded by a frusto-conically shaped baffle.

12. A method for supplying an anti-oxidizing gas to, and simultaneously cooling a shaft and a fan blade used in, a special atmosphere heat treatment chamber and for minimizing corrosion of the shaft and fan blade, comprising the steps of:

providing an elongate enclosure around an end section of a shaft having an outer end mounting a fan blade;

surrounding a portion of the enclosure surrounding a portion of the shaft section located inwardly of a point where the fan blade is mounted to the outer end of the shaft section with a water jacket;

directing water into the water jacket surrounding said portion of the enclosure surrounding said portion of the shaft section within the shaft enclosure;

supplying anti-oxidizing filler gas to the chamber through the enclosure; and directing the gas to and through the enclosure along the shaft section, into and through the fan blade and then into the chamber for establishing a preheated, special atmosphere in the chamber.

13. A shaft mounting structure for a shaft section that extends into a special atmosphere, heat treatment chamber and has a fan blade mounted on an outer end hereof in the heat treatment camber, comprising: a shaft cooling and protecting system including: an insulating jacket comprising a housing; an enclosure in said housing around said shaft section extending to said fan blade; a water jacket surrounding a portion of said shaft enclosure located inwardly of a point where said fan blade is mounted to said outer end of said shaft section; means for directing water into said water jacket surrounding said portion of said shaft enclosure; means for supplying anti-oxidizing filler gas through said enclosure to said heat treatment chamber; and means for directing the gas radially to said enclosure and radially to and axially along said shaft section to and through said fan blade and into said heat treatment chamber.

* * * * *

UNITED STATES PATENT AND TRADEMARK OFFICE

CERTIFICATE OF CORRECTION

PATENT NO. : 5,934,871

DATED : August 10, 1999

INVENTOR(S) : Donald G. Murphy

It is certified that error appears in the above-indentified patent and that said Letters Patent is hereby corrected as shown below:

Claim 01, Column 04, line 30, After "outer" insert --end--

Claim 13, Column 06, line 15, "camber" should be --chamber--

Signed and Sealed this

Thirty-first Day of October, 2000

*Attest:*

*Attesting Officer*

Q. TODD DICKINSON

*Director of Patents and Trademarks*